United States Patent [19]

Groendyke

[11] Patent Number: 4,752,033

[45] Date of Patent: Jun. 21, 1988

[54] SOIL CAP FOR VEGETATION SPRINKLER

[75] Inventor: Richard L. Groendyke, Canyon Lake, Calif.

[73] Assignee: Champion Brass Manufacturing Co., Los Angeles, Calif.

[21] Appl. No.: 946,716

[22] Filed: Dec. 29, 1986

[51] Int. Cl.[4] ..... B05B 15/00

[52] U.S. Cl. ..... 239/288; 239/205

[58] Field of Search ..... 239/201-206, 239/288, 288.3, 288.5

[56] References Cited

U.S. PATENT DOCUMENTS 1,837,322 12/1931 Hamilton ..... 239/201

3,265,310 8/1966 Cohen ..... 239/203

4,479,611 10/1984 Galvis ..... 239/205

*Primary Examiner*—Andres Kashnikow

*Assistant Examiner*—Karen B. Merritt

*Attorney, Agent, or Firm*—Harlan P. Huebner

[57] ABSTRACT

A soil cap for a vegetation water sprinkler which is removably secured to a sprinkler and said cap will prevent entry of soil or debris during installation of a ground sprinkler system yet has a yieldable portion to allow water therethrough for testing and purging the sprinkler system. The cap includes relatively shallow threads to engage sprinkler threads that will allow for easy finger removal yet will retain the cap in place during water pressure testing and purging.

7 Claims, 2 Drawing Sheets

SOIL CAP FOR VEGETATION SPRINKLER

BACKGROUND OF THE INVENTION

1. Field of the Invention

This invention relates to a soil cap for a garden, vegetation, or lawn sprinkler to prevent soil and debris from falling into a sprinkler or pipe line system during installation of the same.

2. Description of the Prior Art

With the installation of residential, commercial and golf course sprinkler systems trenches are usually dug for the pipes. On the pipes at predetermined locations pipe risers are installed and on top of the pipe risers sprinkler housings are usually threaded into place.

Usually the sprinkler housings during installation do not include sprinkler heads but are open. This is initially done so that should there be any soil or other debris that falls into the line or system, water may be turned on and the system flushed or purged. Also, it is done because it may not be known during installation what type of sprinkler head is required for a particular application.

In order to offer some form of protection against soil and debris entering the system during construction, duct tape in the past has been put over the sprinkler housing opening. This however has required the landscape contractor and employees to take additional time in going around through the system applying the tape.

The other type of previous action has been to not cover the housings with anything and leave it to chance that soil and debris would not fall into the lines.

SUMMARY OF THE INVENTION

It is a purpose of the present invention to provide a soil cap that when installed on a stem of a sprinkler housing will prevent soil and debris from entering the sprinkler system, yet allow water to pass through to purge or flush the system.

Another object of the invention is to provide a plastic soil cap that is installed on a sprinkler stem of a housing at the plant where the sprinkler is manufactured.

A further object of the invention is to provide a plastic soil cap that contains shallow threads to affix the cap to a sprinkler stem or riser to maintain the same, yet is easily removable by "stripping" without unthreading the same by mere upward finger pull pressure.

A still further object of the invention is to provide a flexible barrier wall in the cap in the form of bendable tabs, flaps or sections that are each separate one from the other yet each has a common annular base with the annual wall of the cap.

Another object of the invention is to provide a finger tab thereon to be grasped to dislodge the soil cap from the sprinkler raiser.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
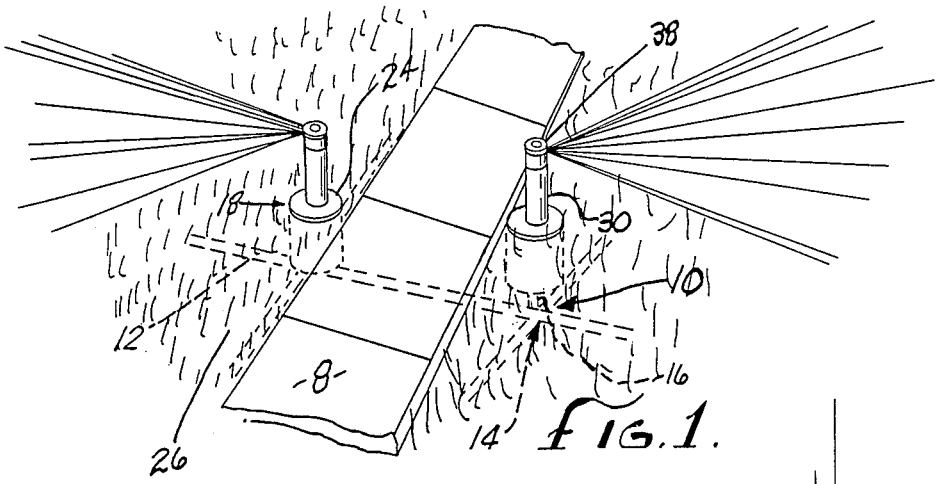
FIG. 1 is an environmental view of a representation of a garden sprinkler system with pop up sprinklers.

In FIG. 1 there is a representation of a partial sprinkler system generally designated 10 on either side of a sidewalk 8 which system 10 would include a series of water pipes 12 (shown in dotted lines) which are joined at junctures 14. The usual practice is that at the junctures 14 a vertical riser pipe 16 is threadably mounted onto a coupling (not shown).

Figure 2:
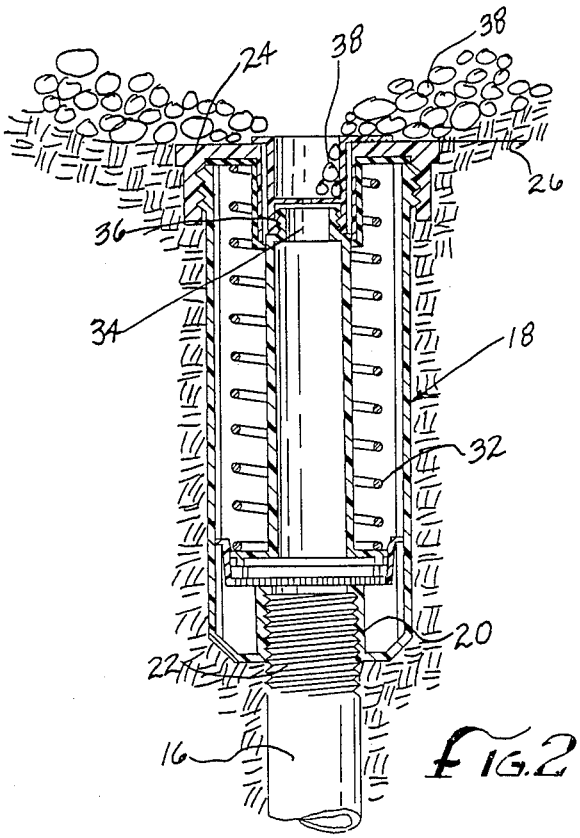
FIG. 2 is a side elevational cross sectional view of a pop-up sprinkler fitted with the soil cap of the present invention.

As best seen in FIG. 2 mounted atop the water pipe riser 16 is a conventional sprinkler housing generally designated 18. The housing includes a threaded end 20 that is secured onto the threads 22 of the water pipe riser 16. The housing 18 has a top plate or cover 24 which may be threaded onto the housing 18 or otherwise secured and usually is flush with the groung 26. The cover 24 has a central opening 28 therethrough to receive a sprinkler stem or riser 30 which may be spring loaded by means of spring 32 and slidably mounted for up and down movement within the housing 18 and out the opening 28, see FIG. 3. The upward movement of the riser is caused by water pressure.

The embodiment illustrated shows the sprinkler riser 30 has an upper reduced sprinkler head receiving portion 34 which has exterior threads 36. The portion 34 is adapted to receive a conventional water distribution sprinkler head (not shown) to distribute water from the system 10.

In the usual course of events once trenches are dug for the sprinkler system 10, pipes 12 are laid, pipe risers 16 secured in place and the sprinkler housing 18 secured and then the trenches are filled in with soil. It is normally desirable that the soil fill the trenches to the height of the cover 24 so they are generally flush with the ground level.

Unless extreme care is taken when filling in around the sprinkler system, soil, gravel and other foreign matter 38 may fall into the riser 30.

To prevent soil 38 from falling into the system a soil cap generally designated 40 is provided for each riser 30 of the sprinkler housing 18.

The soil cap 40 of the present invention is preferably formed of plastic and is adapted to be removably secured on the threads 36 of the upper head receiving portion 34 of the riser 30.

The cap 40 is generally cup shaped and includes an annular wall 42 with a bottom annular edge 44 and top edge 46. Extending annularly outward of the top edge 46 is a top annular flange 48 which includes an under side 50 that will rest on the top of sprinkler housing top cover 24, see FIG. 2 when the riser is at rest. The length of the cap 40 is such as to allow the riser to fully retract and allow the flange 48 to seal against the housing top cover 24

Projecting outwardly of the annular flange 48 is engagement means or a finger tab 52 and which on its underside is formed with serrations 54. The tab 52 is to be gripped by fingers to remove it from the riser 30 and the serrations are for engagement of a persons finger nail to help in lifting the cap 40.

In order to secure the cap 40 to the threads 36 of the riser 30, shallow threads 56 are formed on the interior wall 58 adjacent edge 44. Preferably the threads 56 are shallow so as to easily remove the cap 40 by upward pull without unthreading the cap, yet being deep enough to withstand dislodgement by water pressure passing through the system.

Mounted within the cap 40 is an annular wall member 60 that closes the interior surface 58 of the cap 40. The wall member 60 preferably includes a relatively small central opening 62 cut through the wall. In addition, the wall member 60 includes cuts 64 and 66 normal to each other which extend diametrically across the wall from the annular wall 58 through the opening 62.

Figure 3:
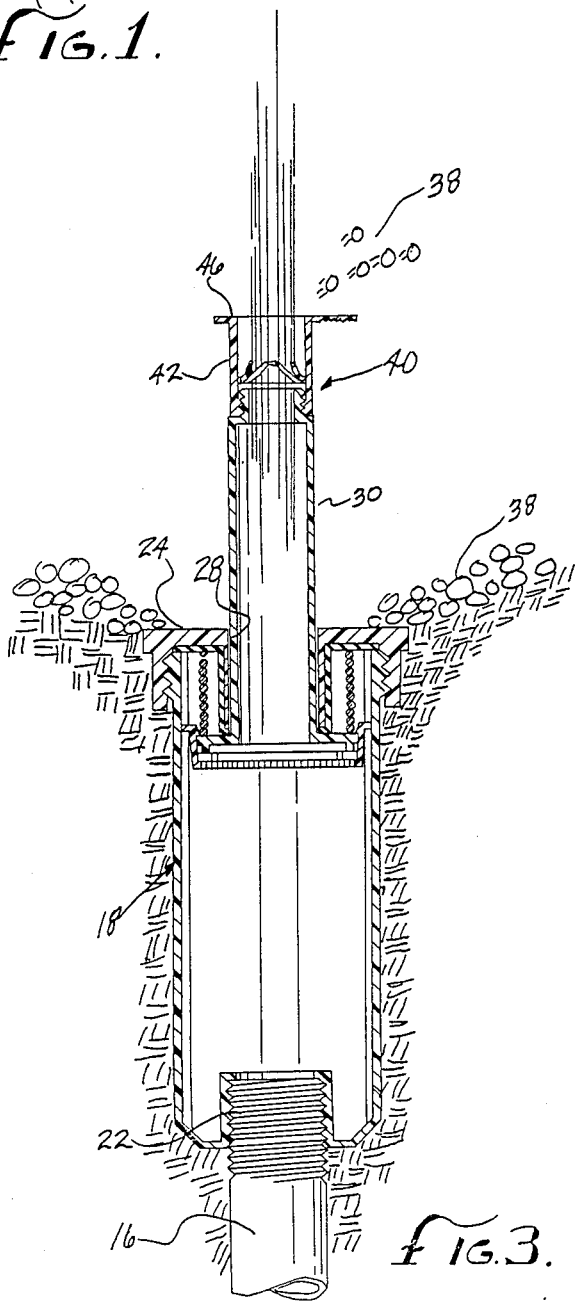
FIG. 3 is a view similar to FIG. 2 with water being turned on and the sprinkler riser extending out of the housing and fitted with the present invention to purge the system.
Figure 4:
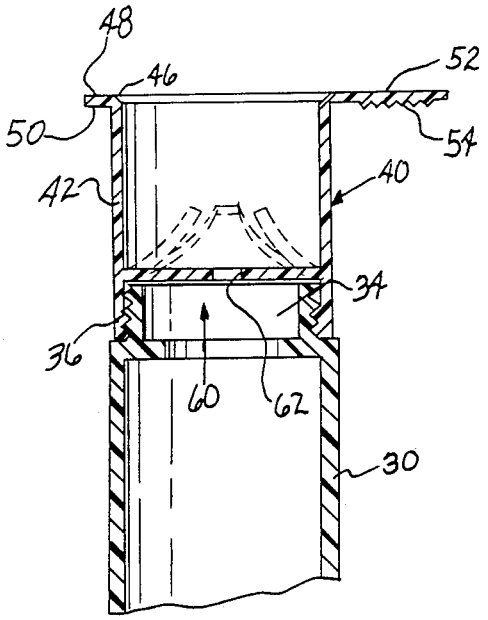
FIG. 4 is an enlarged side elevational cross sectional view of the soil cap of the present invention fitted to a sprinkler riser.
Figure 5:
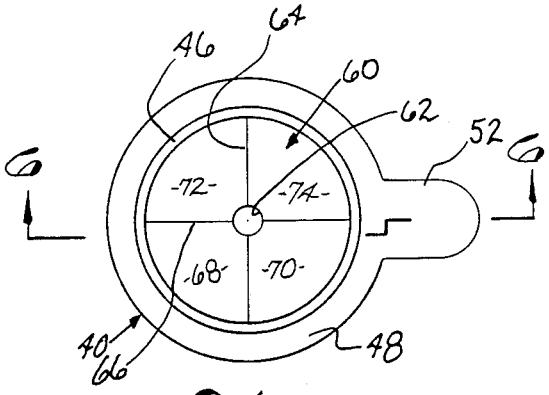
FIG. 5 is a top plan view of the soil cap of the present invention.
Figure 6:
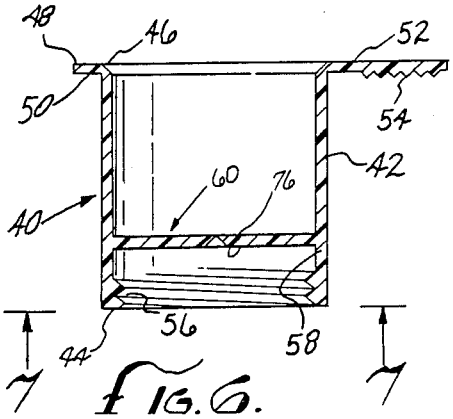
FIG. 6 is a side elevational cross sectional view of the soil cap taken on line 6—6 of FIG. 5.
Figure 7:
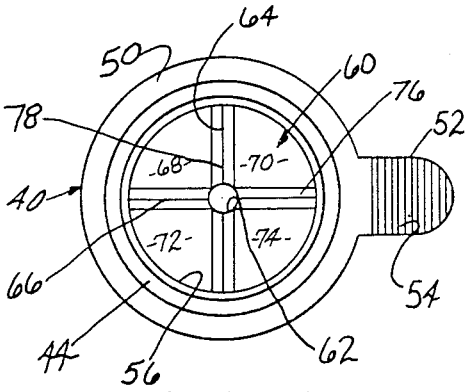
FIG. 7 is a bottom plan view of the soil cap taken on line 7—7 of FIG. 6.

The cuts 64 and 66 thus form four generally wedge shaped sections 68, 70, 72 and 74 each of which is flexible, as best seen in FIG. 4. The slits or cuts 68, 70, 72 and 74 are beveled on the underside at 76 and 78. This will allow independent flexibility of the sections without binding one with the other. In addition, the center opening 62 is formed to prevent any binding of the sections at the apices as they bend, as best seen in FIG. 3 and 4.

While preferably four sections 68, 70, 72 and 74 are shown it should be appreciated that three or more sections may be used without departing from the spirit of the invention.

In operation the cap 40 is secured to the sprinkler riser 30 as explained before. During construction of the sprinkler system 10 soil 38 may fall into the cap 40 as best seen in FIG. 2. The wall 60 will act as a bearer and stop soil and debris 38 from falling into the system.

Once the system is complete water can be turned on and due to the flexibility of the wedge shaped sections 68, 70, 72, and 74 of the wall 60 the water pressure will cause the riser 30 to move out of the housing and flex the sections throwing out the soil 38 purging the system.

After the system is purged the caps 40 may be easily removed as previously stated and the sprinkler heads threaded onto the threaded upper end 36 of the risers 30.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A soil cap for removable attachment to a sprinkler having a top surface with a central opening therethrough, said cap to be used during construction of a water sprinkler system to prevent entry of soil or debris into the system through said sprinkler yet yieldable enough to allow water in said system to pass outwardly through said cap for testing and purging, said cap comprising:

a generally cup shaped body portion with a top annular flange, said cap adapted to engage said top surface of said sprinkler and prevent soil from entering therebetween and said cup shaped body adapted to interfit within said central opening and prevent soil from entering said sprinkler;

engagement means on said flange to assist in removal of said soil cap from said sprinkler;

holding means on said cup shaped body portion remote from said top annular flange adapted to engage a portion of said sprinkler and releasably retain said cap within said central opening; and a flexible wall means extending across the annular interior of said cup shaped body between said top annular flange and said holding means, said wall means adopted to prevent entry of soil yet yieldable to allow water within said system to exit therethrough.

2. A soil cap as defined in claim 1 wherein said engagement means includes:

a tab extending outwardly from said annular flange, said tab having a bottom surface; and serration means on said bottom surface to assist in finger nail and finger gripping of said tab for removal of said cap.

3. A soil cap as defined in claim 1 wherein said holding means includes:

exterior threads on said portion of said sprinkler; and a plurality of relatively shallow threads on the interior of said cup adapted to engage said threads of said portion of said sprinkler and retain the cap in place against water pressure exerted through said system yet allowing easy stripping removal by pulling on the same.

4. A soil cap as defined in claim 1 wherein said flexible wall means includes:

a plurality of cuts projecting radially inward from said cup shaped body and through said wall intersecting at the center of said wall;

said cuts defining a plurality of generally wedge shaped sections which in an at rest position form a barrier wall across said cup, yet are bendable upwardly by water pressure in said system creating an opening to allow water and debris to pass upwardly and outwardly to purge and test said system.

5. A soil cap as defined in claim 4 wherein there are two cuts normal to each other and crossing each other forming four wedge shaped sections.

6. A soil cap as defined in claim 4 wherein the wall includes an upper and lower surface, and the lower surface of said wall adjacent said cuts are beveled to prevent binding of said wedge shaped sections during flexation.

7. A soil cap as defined in claim 1 wherein said cup shaped body is formed of resilient plastic.

* * * * *